US009053893B2

(12) United States Patent
Reijonen et al.

(10) Patent No.: US 9,053,893 B2
(45) Date of Patent: Jun. 9, 2015

(54) RADIATION GENERATOR HAVING BI-POLAR ELECTRODES

(71) Applicant: Schlumberger Technology Corporation, Sugar Land, TX (US)

(72) Inventors: Jani Reijonen, Princeton, NJ (US); Frederic Gicquel, Pennington, NJ (US); Joel L. Groves, Leonia, NJ (US); Peter Wraight, Skillman, NJ (US); Kenneth E. Stephenson, Plainsboro, NJ (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 13/829,697

(22) Filed: Mar. 14, 2013

(65) Prior Publication Data

US 2014/0263996 A1 Sep. 18, 2014

(51) Int. Cl.
*H01J 27/02* (2006.01)
*G21G 4/02* (2006.01)

(52) U.S. Cl.
CPC ..... *H01J 27/024* (2013.01); *G21G 4/02* (2013.01)

(58) Field of Classification Search
CPC .... H01J 37/08; H01J 37/3171; H01J 2237/08
USPC ..... 250/256
See application file for complete search history.

(56) References Cited

U.S. PATENT DOCUMENTS

| | | | | |
|---|---|---|---|---|
| 3,930,163 | A * | 12/1975 | Gerlach et al. | 250/398 |
| 5,293,410 | A | 3/1994 | Chen et al. | |
| 2002/0043621 | A1* | 4/2002 | Aitken | 250/281 |
| 2011/0114830 | A1* | 5/2011 | Reijonen et al. | 250/251 |
| 2011/0180698 | A1 | 7/2011 | Stephenson | |
| 2012/0091359 | A1* | 4/2012 | Lanio et al. | 250/396 R |

OTHER PUBLICATIONS

International Search Report and the Written Opinion for International Application No. PCT/US2014/018280 dated Dec. 10, 2014.

* cited by examiner

*Primary Examiner* — Marcus Taningco
(74) *Attorney, Agent, or Firm* — Cathy Hewitt; Michael Dae

(57) ABSTRACT

A radiation generator includes an insulator, with an ion source carried within the insulator and configured to generate ions and indirectly generate undesirable particles. An extractor electrode is carried within the insulator downstream of the ion source and has a first potential. An intermediate electrode is carried within the insulator downstream of the extractor electrode at a ground potential and is shaped to capture the undesirable conductive particles. In addition, a suppressor electrode is carried within the insulator downstream of the intermediate electrode and has a second potential opposite in sign to the first potential. A target is carried within the insulator downstream of the suppressor electrode. The extractor electrode and the suppressor electrode have a voltage therebetween such that an electric field generated in the insulator accelerates the ions generated by the ion source toward the target.

22 Claims, 2 Drawing Sheets

RADIATION GENERATOR HAVING BI-POLAR ELECTRODES

FIELD OF THE DISCLOSURE

This disclosure relates to a radiation generator, and, more particularly, to a radiation generator having electrodes with roughly opposite potentials.

BACKGROUND

A neutron generator may include an ion source and a target. An electric field is generated within the neutron generator that accelerates the ions toward the target at a speed sufficient such that, when the ions are stopped by the target, neutrons are generated and emitted into a formation into which the neutron generator is placed. The neutrons interact with atoms in the formation, and those interactions can be detected and analyzed in order to determine information about the formation.

While well logging instruments utilizing these neutron generators are useful, they suffer from some unfortunate drawbacks. For example, commonly used ion sources may emit conductive particles that may build up on insulating surfaces inside the neutron generator, thereby changing the characteristics of those insulating surfaces. This in turn may undesirably affect the electric field inside the neutron generator, and therefore alter the focus point of the ion beam, which may result in the ion beam not striking the intended portion of the target. The foregoing serves to degrade the performance of the neutron generator, and thus the performance of the well logging instrument utilizing the neutron generator.

Another drawback is that some ions generated by the ion generator may be neutralized by interactions with gases inside the neutron generator. These energetic neutral particles may impinge on a conductive electrode surface, ejecting charged particles such as electrons, and conductive particles such as sputtered metal that could land on an insulator, creating a layer on the insulator which may be charged and may be conductive.

As such, further advances in the area of neutron generators are desirable. It is desired for such new neutron generators to reduce the buildup of undesirable charged or conductive particles on insulating surfaces, and thus provide a high degree of stability and consistency, such that they can deliver a tightly focused ion beam to the target and consistently generate neutrons.

SUMMARY

This summary is provided to introduce a selection of concepts that are further described below in the detailed description. This summary is not intended to identify key features of the claimed subject matter, nor is it intended to be used as an aid in limiting the scope of the claimed subject matter.

According to a first aspect, a radiation generator may include an insulator, and a ion source carried within the insulator and to directly generate ions and indirectly generate undesirable particles. An extractor electrode may be carried within the insulator downstream of the ion source and having a first potential. In addition, an intermediate electrode may be carried within the insulator downstream of the extractor electrode at a ground potential and may be shaped to capture the undesirable charged or conductive particles indirectly generated by the ion source. A suppressor electrode may be carried within the insulator downstream of the intermediate electrode and having a second potential opposite in sign to the first potential. A target may be carried within the insulator downstream of the suppressor electrode, and the extractor electrode and the suppressor electrode may have a voltage therebetween such that an electric field generated in the insulator accelerates the ions generated by the ion source toward the target.

Another aspect is directed to a well logging instrument. The well logging instrument may include a sonde housing, with a radiation generator carried by the sonde housing. A solid insulator may be carried by the sonde housing between an inner surface of the sonde housing and an outer surface of the radiation generator. There may be an insulating gas in the sonde housing. The radiation generator may include a sealed generator tube, a charged particle source carried within the sealed generator tube and to emit charged particles, an extractor electrode carried within the sealed generator tube downstream of the charged particle source at a first potential, an intermediate electrode carried within the sealed generator tube downstream of the extractor electrode, a suppressor electrode carried within the sealed generator tube downstream of the intermediate electrode at a second potential opposite in sign to the first potential, and a target within the sealed generator tube downstream of the suppressor electrode. The intermediate electrode may be at an intermediate potential between the first and second potential. The difference in the first and second potentials may be such that an electric field generated in the sealed generator tube accelerates the charged particles emitted by the charged particle source toward the target.

A method aspect is directed to a method of generating radiation. The method may include generating ions and indirectly generating undesirable particles, the undesirable particles being generated on a trajectory toward an insulator, using an ion source. The method may also include accelerating the ions toward a target within the insulator using an extractor electrode downstream of the ion source at a first potential and a suppressor electrode downstream of the extractor electrode at a second potential opposite in sign to the first potential. The method may further include shielding the insulator from the undesirable particles that would otherwise strike the insulator, using an intermediate electrode downstream of the extractor electrode and upstream of the suppressor electrode at a ground potential.

DETAILED DESCRIPTION

One or more embodiments of the present disclosure will be described below. These described embodiments are only examples of the presently disclosed techniques. Additionally, in an effort to provide a concise description, some features of an actual implementation may not be described in the specification. It should be appreciated that in the development of any such actual implementation, as in any engineering or design project, numerous implementation-specific decisions may be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

Figure 1:
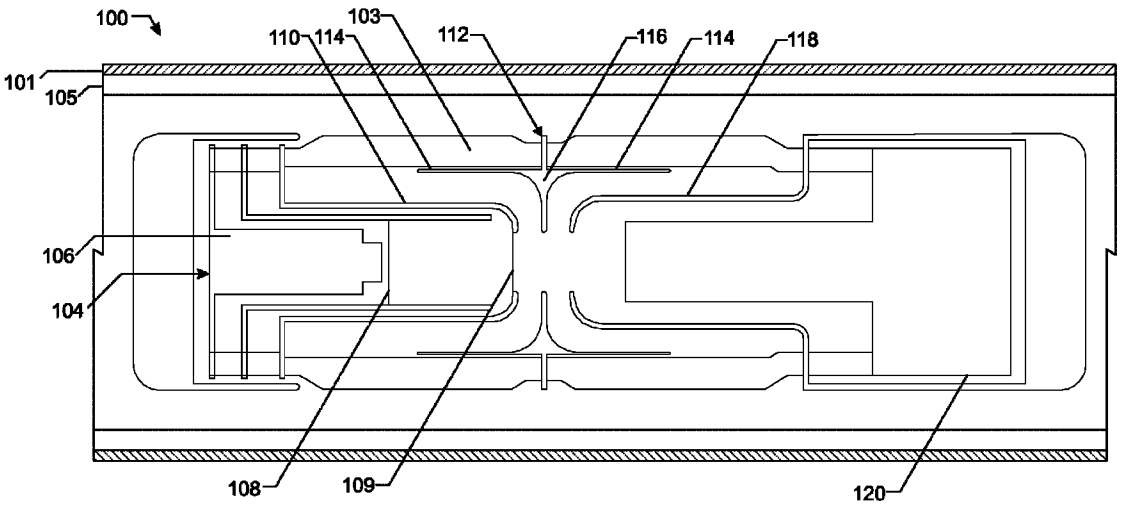
FIG. 1 is a schematic cross sectional view of a neutron generator according to the present disclosure.

Referring initially to FIG. 1, a radiation generator 100 is now described. The radiation generator 100 includes a housing 101 having an interior surface, with an insulator 105 on the interior surface. The housing 101 carries a vacuum envelope formed by the insulator 103 and the various electrodes attached thereto. The insulator 103 may be a high voltage insulator constructed from ceramic material, such as $Al_2O_3$. An ionizable gas is contained within the housing, such as deuterium or tritium, at a pressure of 2 mTorr to 20 mTorr for example. An insulating gas, for example $SF_6$, is contained within the housing 101.

An ion source 104 is carried within the housing. The ion source 104 includes a cathode 106, a cathode grid 108 downstream of the cathode, and an extractor grid 109 downstream of the cathode grid. During operation of the radiation generator 100, the cathode 104 emits electrons. The cathode 106 and the cathode grid 108 have a voltage therebetween such that the electrons emitted by the cathode are accelerated toward the cathode grid. The cathode grid 108 and the extractor grid 109 have a voltage therebetween less than the voltage between the cathode 106 and cathode grid 108. As the electrons pass the cathode grid 108 on a trajectory toward the extractor grid 109, they slow down due to the lesser voltage between the cathode grid and extractor grid. Some electrons then strike the atoms of the ionizable gas, resulting in ionization. Although the structure of this ion source 104 has been described herein, those of skill in the art will readily appreciate that other types of ion sources, such as those that operate at a lower temperature and based upon a Penning discharge, may be used. Indeed, the disclosure herein is applicable to any sort of radiation generator, regardless of cathode type.

The radiation generator 100 also includes an extractor electrode 110 carried within the housing downstream of the ion source 104 that, during operating, is at a first potential. The extractor electrode 110 is curved inwardly toward a longitudinal axis of the insulator, which provides advantages that will be discussed below.

An intermediate electrode 112 is carried within the housing downstream of the extractor electrode 110. A suppressor electrode 118 is carried within the housing downstream of the intermediate electrode 112 and, during operation, is at a second potential. The suppressor electrode 118 is curved inwardly toward a longitudinal axis of the insulator 103, which also provides advantages that will be discussed below. During operation, the intermediate electrode is at a potential between that of the extractor and the suppressor. The intermediate electrode may be substantially at ground potential while the suppressor and extractor are at potentials with opposite signs but not necessarily of equal magnitude. This may be achieved by having a first power source (not shown) coupled to the extractor electrode 110 to drive it to the first potential, and a second power source (not shown) coupled to the suppressor electrode 118 to drive it to the second potential.

Those skilled in the art will appreciate that there may be other extractor electrodes downstream of the extractor electrode 110 shown, and that there may be other suppressor electrodes downstream of the suppressor electrode 118. There may be a first voltage divider circuit (not shown) coupled to the first power source and to each extractor electrode 110 so as to provide an increasing absolute voltage difference between the extractor 110 and each successive extractor electrode. In addition, there may be a second voltage divider circuit (not shown) coupled to each suppressor electrode 118 so as to provide an increasing absolute voltage difference between the intermediate electrode 112 and each successive suppressor electrode.

A target 120 is carried within the housing downstream of the suppressor electrode 118. There is a voltage difference between the extractor electrode 110 and the suppressor electrode 118 such that an electric field generated in the housing accelerates the ions emitted by the ion source 104 toward the target 120. When the ions strike the target 120, neutrons or gamma rays, depending upon the selection of the target material, are generated. The neutrons or gamma rays can be emitted into a material, such as a formation in a borehole. The neutrons react with nuclei in the formation, and can be either reflected back, or can cause photons such as gamma ray photons to be reflected back. These reflected neutrons or gamma ray photons can be captured by a detector (not shown). Monitoring of the detector, together with analysis of the data collected thereby, can then be used to determine properties of the material in the formation. It should be noted that there is a negative difference in potential between the suppressor electrode 118 and the target 120 such that secondary electrons formed when the ions strike the target or gas between the suppressor electrode and target are directed back toward the target instead of toward the ion source 104. If the electrons were allowed to fly back toward the ion source 104, they could strike the cathode 106, heating the surface thereof and potentially generating unwanted x-rays which could damage the insulators 103 or 105. The electrons could also strike the insulator 103 and charge it up, causing asymmetrical potential distribution.

A limiting factor in prior radiation generator 100 designs is the length of the acceleration gap between the extractor electrode 110 and the suppressor electrode 118. The pressure of the ionizable gas in the housing causes a variety of undesirable reactions between the accelerated ions and the ionizable gas itself, and the longer the acceleration gap, the greater the chance of these undesirable reactions. These reactions can include the formation of neutral, accelerated particles that can impinge metal surfaces inside the accelerator and the resulting creation of undesirable charged or conductive particles via sputtering, which can strike the insulator 103 and build up thereon.

If enough undesirable charged or conductive particles build upon the insulator, portions of the surface of the insulator 103 may become charged and/or conductive. This would serve to alter the potential distribution between the extractor electrode 110 and suppressor electrode 118, as well as other components. This could alter the electric field in the housing, and thus alter the path or cohesiveness of the ion beam, which would degrade performance of the radiation generator 100. Worse, with enough undesirable conductive particles building up the insulator 103, a short could form between the extractor electrode 110 and suppressor electrode 118, or between other components, for example. Such a short could result in damage to the radiation generator 100 rendering it inoperable.

Another concern is the creation of undesirable neutral particles. These undesirable neutral particles are formed when ions strike or interact with molecules of the ionizable gas in the acceleration gap. In this situation, an electron from the ionizable gas jumps to the ion, turning the ion into a neutral particle. The energy and direction of the newly formed neutral particle remains, yet because the particle is neutral, the electric field in the housing does not influence its trajectory.

If this particle strikes a metallic surface in the radiation generator 100 it may sputter material therefrom as well as cause secondary electron emission. The material sputtered would be in the form of undesirable conductive particles, the undesirable properties of which have been described above. As also explained above, the secondary electrons could strike the insulator 103 and charge it up, or could strike a metallic surface and cause the generation of x-rays, which could in turn damage the high voltage insulator 105 between the generator 100 and the grounded housing 101. Also, secondary electron emission can lead to erroneous current flow, which could overload the power supplies.

Yet another reason why it is desirable for the acceleration gap to be kept as small as possible is to reduce the likelihood of a charge exchange reaction between an initially accelerated ion and an atom of ionizable gas. In the charge exchange reaction, the initially positively charged ion picks up an electron from an atom of ionizable gas, creating a neutral particle (the negatives of which are explained above), as well as creating an ion from the ionizable gas atom. This new ion is an undesirable ion, as it is accelerated by but part of the available potential difference. The undesirable ion may or may not strike the target 120. If it strikes the target 120, its diminished energy makes it more likely to cause target erosion through sputtering and much less likely to cause a neutron generating reaction. It is therefore desirable to keep charge exchange to a minimum by using an acceleration gap of minimal length as charge exchange is more likely at low ion energies.

Those of skill of art will appreciate that since the ion source 104 generates the ions which ultimately generate the undesirable conductive or undesirable neutral particles, which in turn can cause the secondary electron emission, the ion source can be said to indirectly generate the undesirable particles in the radiation generator 100.

By having the extractor electrode 110 and the suppressor electrode 118 at potentials opposite in sign and with a well-defined potential distribution due to the presence of the intermediated electrode(s), the acceleration gap therebetween can be shortened. By shortening the acceleration gap, the number of charge exchange reactions can be reduced. This reduces the number of particles hitting the electrodes and therefore the amount of secondary electron emission. Since the extractor electrode 110 and suppressor electrode 118 are at potentials opposite in sign with respect to the intermediate electrode, the largest potential difference between separate electrodes is reduced compared to conventional radiation generators where the insulating material 103 is to hold off the full potential difference, while the potential difference between the extractor electrode and suppressor electrode can remain the same.

Further, if the intermediate electrode is substantially at ground potential the largest potential difference between the electrodes and the grounded housing, and thus the electric field therebetween is reduced (by a factor of two, in some applications), allows the thickness of the insulation (not shown) surrounding the generator tube 100 to be reduced, as with the lesser electric field comes a lesser chance of arcing and other undesirable effects.

Although the shortened acceleration gap helps reduce these undesirable effects, it may not completely do so. Therefore, to help mitigate performance degradation caused by the undesirable conductive particles and secondary electron emission, the intermediate electrode 112 is shaped to capture the undesirable charged or conductive particles that would otherwise strike the insulator 103. Indeed, the intermediate electrode 112 is T-shaped, comprising a base 114 extending along the longitudinal axis of the insulator 103, and a projection 116 extending outwardly from the base. The projection 116 illustratively has a concave triangular shape. Since the shape of the intermediate electrode 112 captures the undesirable conductive or neutral particles, as well as charged particles, that would otherwise strike the insulator 103, and forces such particles to ground, the electric field in the housing remains unchanged.

In addition, the suppressor electrode 118 can be shaped such that secondary electrons formed on the downstream surface thereof are forced toward the intermediate electrode 112 where they can be forced to ground. This may result in the creation of x-rays, albeit at a lesser energy level than if the x-rays had been created by the secondary electrons striking the extractor electrode 110, because the potential difference between the suppressor electrode 118 and the intermediate electrode 112 is about half the potential difference between the extractor electrode 110 and suppressor electrode 118. Thus, although these x-rays are created, they are less damaging than if they had been formed by the secondary electrons instead striking the extractor electrode 110. Also, in some applications, the intermediate electrode 112 can be shaped such that the secondary electrons formed on the upstream surface thereof are forced toward the extractor electrode 110, resulting in the creation of x-rays lesser in energy than x-rays that would be created by secondary electrons created on the surface of the suppressor 118 electrode striking the extractor electrode 110 in the absence of the intermediate electrode. In addition, a portion of the x-rays generated may be absorbed by the intermediate electrode 112 before they damage the insulators 103 or 105. Thus, the intermediate electrode 112 shields the insulator 103 not only from x-rays but also undesirable charged or conductive particles. It should be appreciated that since the x-rays result from the undesirable charged or conductive particles striking electrodes, the x-ray photons themselves can be considered to be undesirable particles indirectly generated by the ion source.

Furthermore, the extractor electrode 110, intermediate electrode 112, and suppressor electrode 118 can be shaped so as to capture the undesirable charged or conductive particles that would otherwise strike the insulator. In addition, the intermediate electrode can be made of or coated with a low-Z material, such as beryllium, to reduce the creation of x-rays produced by secondary electrons striking the electrode.

Figure 2:
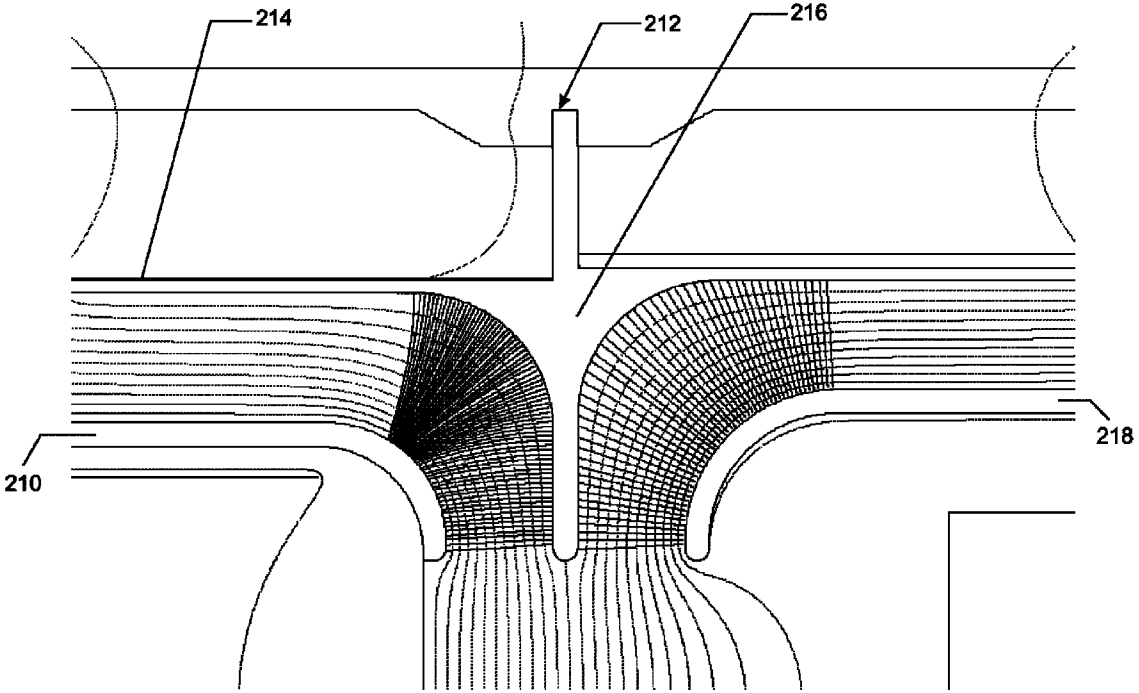
FIG. 2 is a greatly enlarged cross sectional view of the neutron generator of FIG. 1 showing electron trajectories from the upstream surface of the intermediate electrode to the extractor electrode, and from the suppressor electrode to the downstream surface of the intermediate electrode.

FIG. 2 illustrates lines of constant potential in and around the acceleration gap and the trajectories of secondary electrons in and around the acceleration gap. Here, secondary electron emission from the upstream surface of the suppressor electrode 218 and the upstream concave surface of the intermediate electrode 212 is shown. In the case of the suppressor electrode 218, the secondary electrons are generated and leave the surface due to neutral particles striking that surface. As shown, these electrons are then captured by the intermediate electrode 212 and do not fly upstream toward the ion source. In the case of the secondary electrons being generated on the surface of the intermediate electrode 212, also due to neutral particles striking that surface, the secondary electrons, as shown, strike the extractor electrode 210. As explained above, due to the fact that these secondary electrons are accelerated at less than the full potential difference between the extractor electrode 210 and suppressor electrode 218 due to the presence of the intermediate electrode 212, the damage from the resulting x-rays is lessened.

While the disclosure has been described with respect to a limited number of embodiments, those skilled in the art, having benefit of this disclosure, will appreciate that other embodiments can be envisioned that do not depart from the scope of the disclosure as disclosed herein.

That which is claimed is:

1. A radiation generator comprising:

an insulator;

a ion source carried within the insulator and configured to directly generate ions and indirectly generate undesirable particles;

a plurality of extractor electrodes, a first extractor electrode of the plurality of extractor electrodes carried within the insulator downstream of the ion source and having a first potential, and a second extractor electrode of the plurality of extractor electrodes carried within the insulator downstream of the ion source and having a second potential, wherein the first extractor electrode terminates farther downstream from the ion source than the second extractor electrode, and wherein the first potential is closer to ground than the second potential;

an intermediate electrode carried within the insulator downstream of the extractor electrodes and being shaped to capture at least some of the undesirable particles;

a suppressor electrode carried within the insulator downstream of the intermediate electrode and having a third potential opposite in sign to the first potential and the second potential;

the intermediate electrode being at an intermediate potential between the first and third potential; and a target carried within the insulator downstream of the suppressor electrode;

the extractor electrodes and the suppressor electrode having a voltage therebetween such that an electric field generated in the insulator accelerates the ions generated by the ion source toward the target.

2. The radiation generator of claim 1, wherein the intermediate potential is at ground potential.

3. The radiation generator of claim 1, wherein the first extractor electrode is curved inwardly toward a longitudinal axis of the insulator and a portion of the first extractor electrode that is curved has a substantially uniform thickness.

4. The radiation generator of claim 1, wherein the suppressor electrode is curved inwardly toward a longitudinal axis of the insulator.

5. The radiation generator of claim 1, wherein the first extractor electrode is shaped to capture the undesirable particles indirectly generated by the ion source, wherein the first extractor electrode is curved inwardly toward a longitudinal axis of the insulator, whereby an inner diameter of the first extractor electrode is greater at a longitudinal location nearer to the ion source than at a longitudinal location farther from the ion source.

6. The radiation generator of claim 1, wherein the intermediate electrode is shaped to attenuate x-rays undesirably generated in the radiation generator.

7. The radiation generator of claim 1, wherein the intermediate electrode is T-shaped.

8. The radiation generator of claim 1, wherein the intermediate electrode comprises a base extending along the longitudinal axis of the insulator, and a projection extending outwardly from the base.

9. The radiation generator of claim 8, wherein the projection has a concave triangular shape.

10. The radiation generator of claim 1, wherein the intermediate electrode comprises a material having a Z of less than or equal to 13.

11. The radiation generator of claim 1, comprising a sealed housing carrying the insulator, and ionizable gas molecules within the sealed housing; and wherein the ion source comprises:

a cathode configured to emit electrons;

a cathode grid downstream of the cathode;

an extractor grid downstream of the cathode grid;

the cathode and the cathode grid having a first voltage therebetween such that the electrons emitted by the cathode are accelerated toward the grid and downstream;

the cathode grid and the extractor grid having a second voltage therebetween less than the first voltage such that the electrons are decelerated as they approach the extractor grid, at least some of the electrons striking the ionizable gas molecules to create the ions.

12. A well logging instrument comprising:

a sonde housing;

a radiation generator carried by the sonde housing;

a solid insulator carried by the sonde housing between an inner surface of the sonde housing and an outer surface of the radiation generator; and an insulating gas in the sonde housing;

the radiation generator comprising a sealed generator tube, a charged particle source carried within the sealed generator tube and configured to emit charged particles, an extractor electrode carried within the sealed generator tube downstream of the charged particle source at a first potential, an intermediate electrode carried within the sealed generator tube downstream of the extractor electrode wherein the intermediate electrode comprises a base extending along the longitudinal axis of the sealed generator tube, and a projection extending outwardly from the base, wherein the projection comprises a first portion extending from a central point in the base toward the charged particle source and a second portion extending from the central point in the base away from the charged particle source, wherein the first and second portions are substantially symmetrical to each other, a suppressor electrode carried within the sealed generator tube downstream of the intermediate electrode at a second potential opposite in sign to the first potential, and a target within the sealed generator tube downstream of the suppressor electrode, the intermediate electrode being at an intermediate potential between the first and second potential, the difference in the first and second potentials being such that an electric field generated in the sealed generator tube accelerates the charged particles emitted by the charged particle source toward the target;

wherein the intermediate electrode curves in a generally complementary trajectory to the extractor electrode and in a generally complementary trajectory to the suppressor electrode, thereby allowing an acceleration gap between the ion source and the target to be shorter than otherwise, and thereby reducing a number of charge exchange reactions that might otherwise occur.

13. The well logging instrument of claim 12, wherein the intermediate potential is a ground potential.

14. The well logging instrument of claim 12, wherein the extractor electrode is curved inwardly toward a longitudinal axis of the sealed generator tube in a direction away from the charged particle source.

15. The well logging instrument of claim 12, wherein the suppressor electrode is curved inwardly toward a longitudinal axis of the sealed generator tube.

16. The well logging instrument of claim 12, wherein the intermediate electrode is T-shaped.

17. The well logging instrument of claim 12, wherein the projection has a concave triangular shape.

18. A method of generating radiation comprising:

generating ions and indirectly generating undesirable particles, using an ion source within an insulator, the undesirable particles generated on a trajectory toward the insulator;

accelerating the ions toward a target within the insulator using an extractor electrode downstream of the ion source at a first potential and a suppressor electrode downstream of the extractor electrode at a second potential opposite in sign to the first potential; and shielding the insulator from the undesirable particles that would otherwise strike the insulator, using an intermediate electrode downstream of the extractor electrode and upstream of the suppressor electrode at an intermediate potential between the first and second potential and using the extractor electrode, wherein the extractor electrode shields the insulator by curving inwardly toward a longitudinal axis of the insulator away from the ion source, and using the suppressor electrode, wherein the suppressor electrode shields the insulator by curving inwardly toward a longitudinal axis of the insulator toward the ion source, wherein the intermediate electrode curves in a generally complementary trajectory to the extractor electrode and in a generally complementary trajectory to the suppressor electrode, thereby allowing an acceleration gap between the ion source and the target to be shorter than otherwise, and thereby reducing a number of charge exchange reactions that might otherwise occur.

19. The method of claim 18, comprising reducing an electric field that would otherwise be at a surface of the suppressor electrode by shaping the suppressor electrode to be curved inwardly toward a longitudinal axis of the insulator.

20. The method of claim 18, comprising shielding the insulator from the undesirable particles that would otherwise strike the insulator by shaping the extractor electrode to capture the undesirable particles.

21. The method of claim 18, wherein the intermediate electrode comprises a base extending along the longitudinal axis of the housing, and a projection extending outwardly from the base.

22. The method of claim 18, wherein generating the ions comprises:

emitting electrons using a cathode; and accelerating the electrons away from the cathode using a grid downstream of the cathode so that some of the electrons accelerated away from the cathode strike ionizable gas molecules to create the ions.

* * * * *